US006621017B2

(12) United States Patent
Shibutani et al.

(10) Patent No.: US 6,621,017 B2
(45) Date of Patent: Sep. 16, 2003

(54) PUSH-BUTTON SWITCH AND MULTIPLE SWITCH USING THE SAME

(75) Inventors: Shigeru Shibutani, Fukui (JP); Tetsuo Murakami, Osaka (JP); Yoshihiko Kamimura, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 88 days.

(21) Appl. No.: 09/931,871

(22) Filed: Aug. 20, 2001

(65) Prior Publication Data

US 2002/0027062 A1 Mar. 7, 2002

(30) Foreign Application Priority Data

Aug. 21, 2000 (JP) ..... 2000-249347

(51) Int. Cl.[7] ..... H01H 3/00
(52) U.S. Cl. ..... 200/5 A; 200/517; 200/332
(58) Field of Search ..... 200/517, 1 B, 200/5 A, 18, 332

(56) References Cited

U.S. PATENT DOCUMENTS 4,486,637 A * 12/1984 Chu ..... 200/517
4,866,221 A * 9/1989 Obermann et al. ..... 200/18 X
5,012,055 A * 4/1991 Matsui ..... 200/517 X
5,719,361 A * 2/1998 Lee ..... 200/1 B
6,201,202 B1 * 3/2001 Katagiri ..... 200/517 X

* cited by examiner

*Primary Examiner*—Renee Luebke
(74) *Attorney, Agent, or Firm*—Wenderoth, Lind & Ponack, L.L.P.

(57) ABSTRACT

A push-button switch includes an insulating board, an actuator, an urging body and a push button. The insulating board has plural switch-contacts. The actuator is made of resilient material and includes a base section placed on the board, a primary and secondary actuating sections. Both the sections are disposed above the switch-contacts and linked to the base section via respective linking sections. The urging body has a first end rotatably supported by a supporting section formed on the actuator or another supporting section formed on the insulating board, and has a second end for urging the primary actuating section. The push button depresses a mid-section of the urging body. The structure discussed above allows the push-button switch to have various combinations of operating forces and strokes. The push-button switch and a multiple switch employing this push-button switch can be used in various electronic apparatuses.

20 Claims, 11 Drawing Sheets

PUSH-BUTTON SWITCH AND MULTIPLE SWITCH USING THE SAME

FIELD OF THE INVENTION

The present invention relates to a push-button switch employed in various electronic apparatuses, such as television receivers and video cassette recorders, and it also relates to a multiple switch using the push-button switch.

BACKGROUND OF THE INVENTION

Recently, the market has demanded that electronic apparatuses have versatile and advanced functions. This market situation entails versatile applications and specifications for push-button switches. To be more specific, in addition to switching a mono-function with one push-button, the need to move a cursor on a screen, for instance, up and down or side to side with a plurality of push-buttons, and the need to select a menu with another push-button, have increased in the market.

Such a conventional push-button switch is described with reference to FIG. 13 to FIG. 15. FIG. 13 is a cross sectional view of a conventional push-button switch, and FIG. 14 is an exploded perspective view of the same switch. In FIGS. 13 and 14, insulating board 1 has a plurality of conductive patterns (not shown) on its upper and lower faces. A pair of fixed contacts 1A are disposed at the center of the upper surface of board 1, and four sets of fixed contacts 1B are radially formed to be equally spaced apart around contacts 1A.

Actuator 2 is made of resilient material such as rubber. Base section 2A of actuator 2 forms an approximately flat board and overlies insulating board 1. On base section 2A, first actuating section 2B and second actuating section 2C protrude upward, and linking sections 2D and 2E for linking both actuating sections 2B and 2C to base section 2A are formed. Each of linking sections 2D and 2E is formed as a thin dome.

Movable contacts 2F and 2G are formed on the underside of actuating sections 2B and 2C, and face respective fixed contacts 1A and 1B at a given spacing. Case 3, having an open underside, covers actuator 2. Case 3 is made of insulating resin, and has five openings 3A on its upper surface. Through openings 3A, actuating sections 2B and 2C protrude upwardly.

Operation of the conventional push-button switch discussed above will now be described. The upper surfaces of actuating sections 2B and 2C protruding from the upper surface of case 3 are depressed, so that actuating sections 2B and 2C move downward by bending linking sections 2D and 2E. Movable contacts 2F and 2G are brought into contact with fixed contacts 1A and 1B on board 1, thereby closing the pair of contact points 1A and 1B.

When the pressure to the actuating sections is removed, movable contacts 2F and 2G spring back to a neutral position (contacts are open) shown in FIG. 13 due to the elastic restoring force of linking sections 2D and 2E.

This type of push-button switch is mounted to an operation panel of an electronic apparatus, and is connected to an electronic circuit of the apparatus. This switch is used, for instance, in the following application: any one of four second actuating sections 2C is depressed to move the cursor up and down or side to side on the screen, then first actuating section 2B is depressed to select an item from a menu.

In this conventional switch, the shapes or the thickness of actuating sections 2B and 2C or linking sections 2D and 2E can be varied, thereby changing the required operating force or stroke of the switch somewhat. However, it is difficult to set a significantly different required operating force or stroke for respective actuating sections 2B and 2C due to limitations such as size and layout of the entire switch, although the respective actuating sections are to be used for different functions.

SUMMARY OF THE INVENTION

The present invention addresses the problem discussed above, and aims to offer a push-button switch in which the required operating force and stroke can be variously set in accordance with an application. The push-button switch of the present invention comprises the following elements. An insulating board has a plurality of switch-contacts formed thereon. An actuator is made of resilient material and includes a base section on the insulating board; a first actuating section coupled to the base section via its linking section; and a second actuating section coupled to the base section via its linking section. An urging body includes a first end journaled by a supporting section formed on the insulating board or another supporting section formed on the actuator, and a second end for urging the first actuating section. An operating button is arranged for depressing the mid section of the urging body.

This structure allows the push-button switch to be operated in the following way: Depressing force travels to the first actuating section via the urging body and also travels to the second actuating section directly, not via the urging body. The first and second actuating sections thus have substantially different operating forces and strokes, so that various combinations of operating forces and strokes can be used for the push-button switch. A multi-switch device employing this push-button switch can be provided.

DETAILED DESCRIPTION OF THE INVENTION

Exemplary embodiments of the present invention are demonstrated hereinafter with reference to the accompanying drawings. Elements similar to those in the conventional case have the same reference numbers, thus the descriptions of those elements are omitted.

Exemplary Embodiment 1

Figure 1:
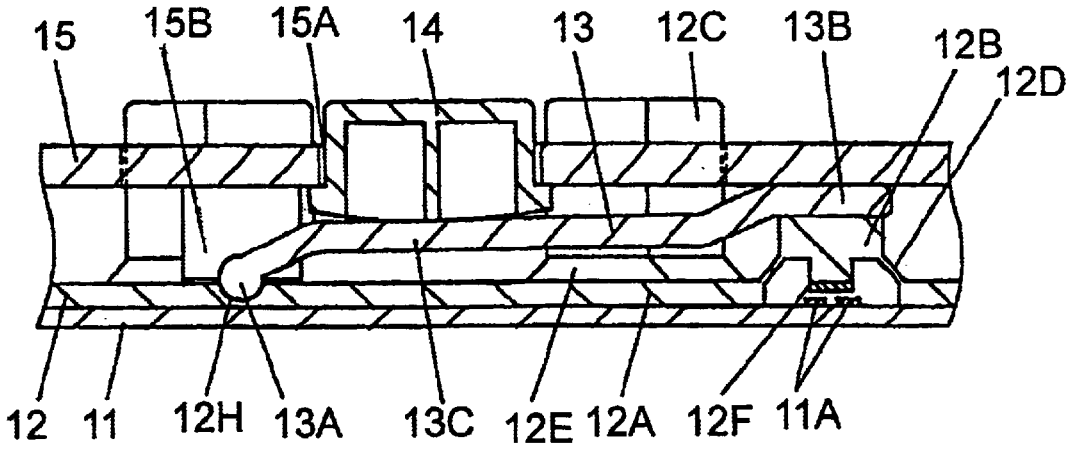
FIG. 1 is a cross section of a push-button switch in accordance with a first exemplary embodiment of the present invention.
Figure 2:
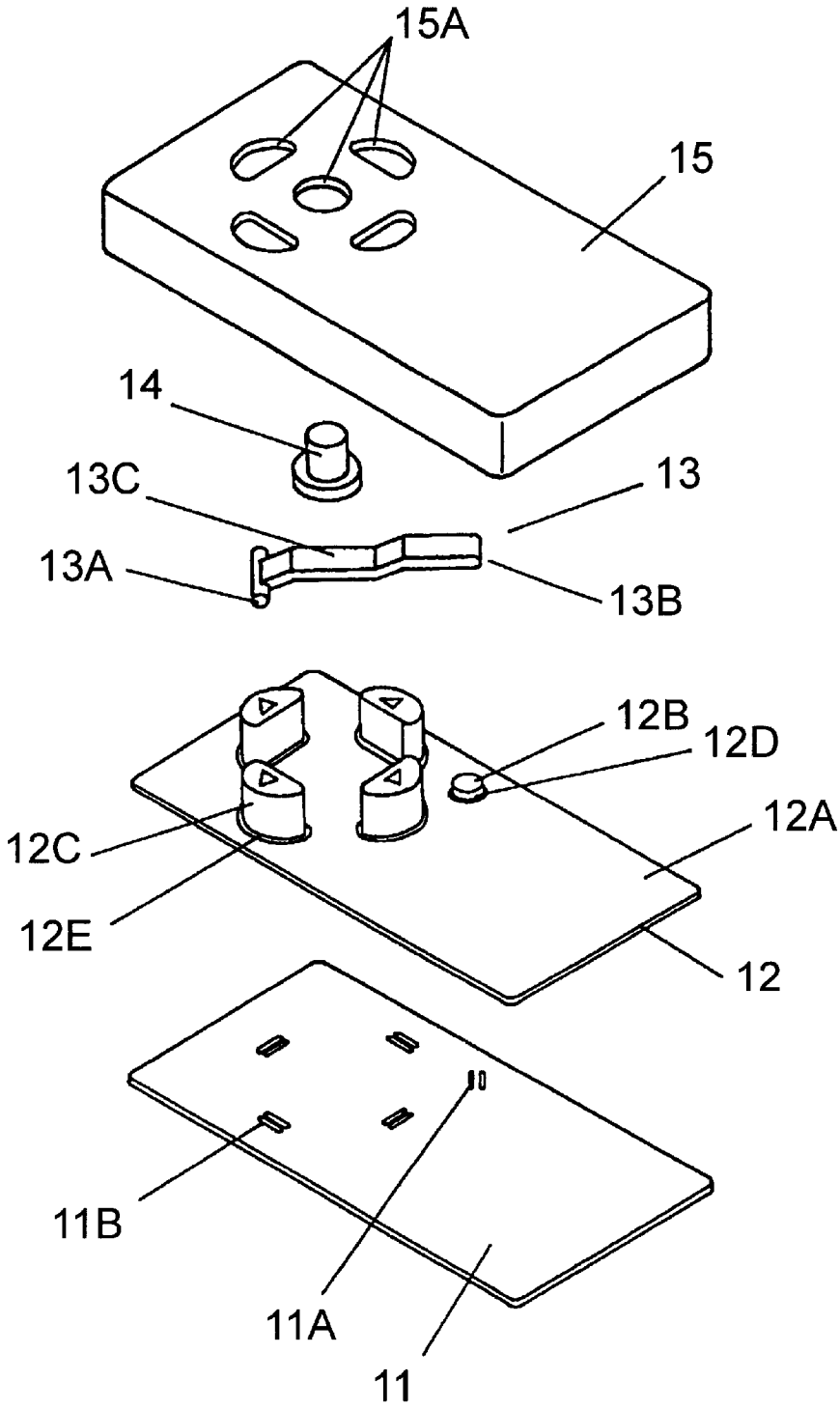
FIG. 2 shows an exploded perspective view of the push-button switch shown in FIG. 1.
Figure 3:
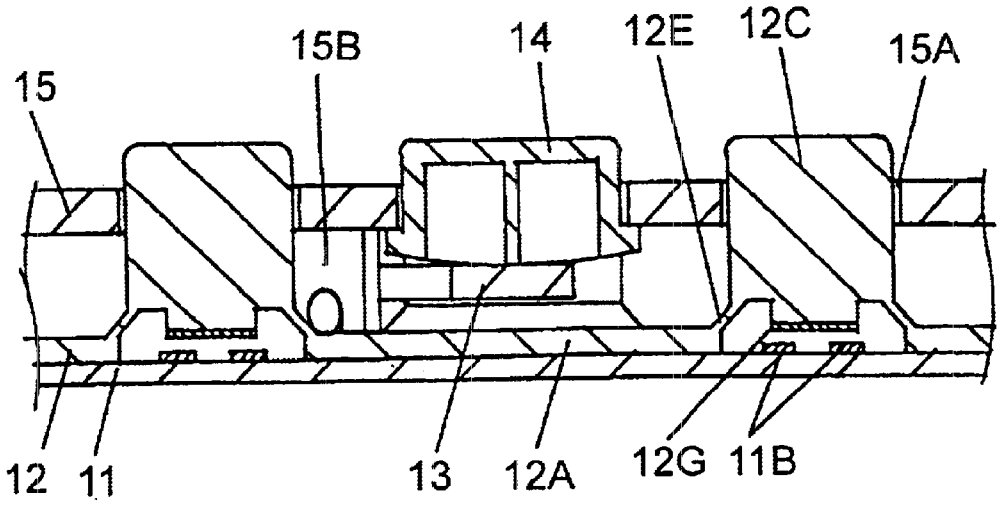
FIG. 3 is a cross section of the push-button switch in accordance with the first exemplary embodiment taken along a line different from that of FIG. 1.
Figure 4:
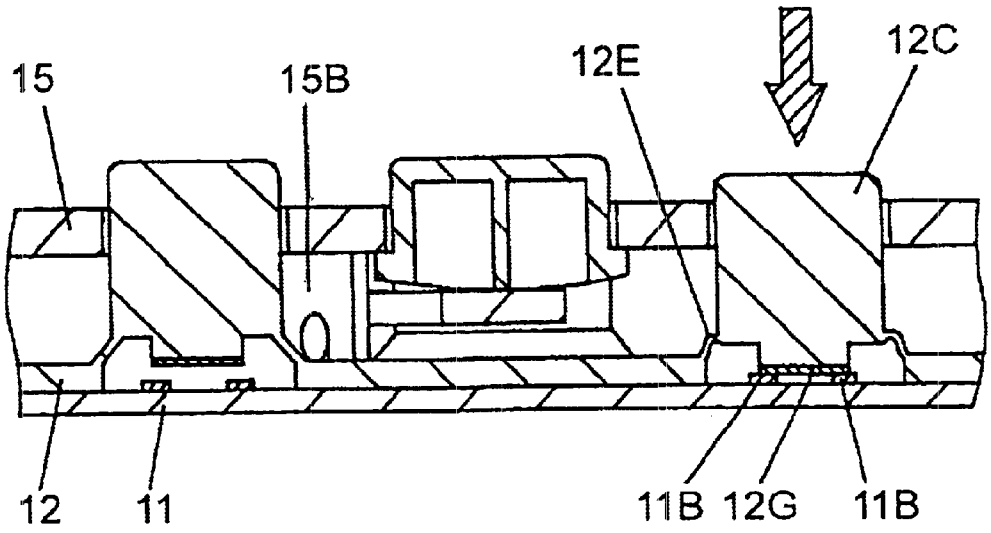
FIG. 4 and FIG. 5 are cross sections of the push-button switch during operation in accordance with the first exemplary embodiment of the present invention.
Figure 5:
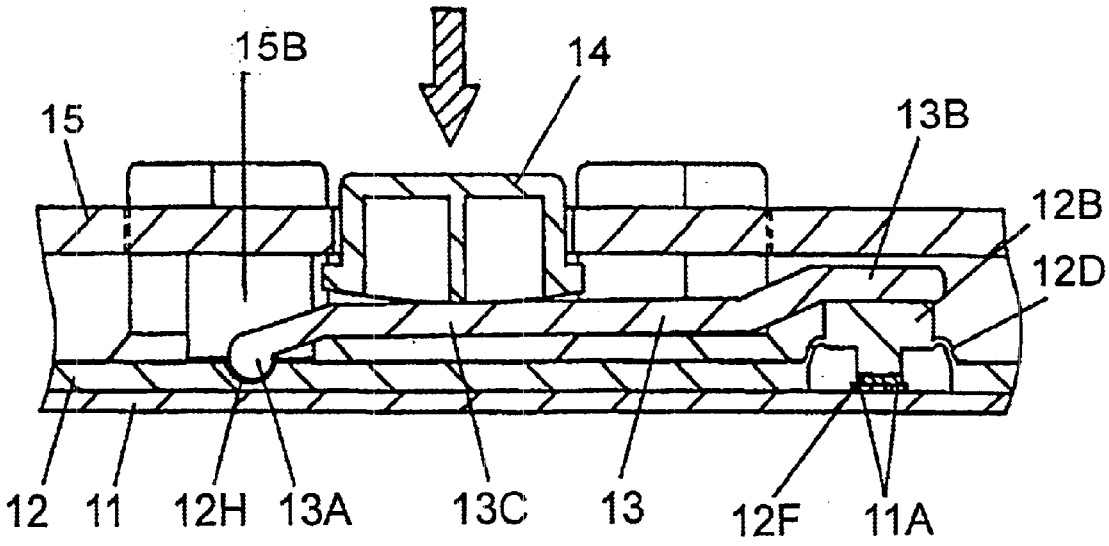

FIG. 1 is a cross section of a push-button switch in accordance with a first exemplary embodiment of the present invention. FIG. 2 shows an exploded perspective view of the push-button switch shown in FIG. 1. FIG. 3 is a cross section of the push-button switch in accordance with the first exemplary embodiment taken along a line different from that of FIG. 1. FIG. 4 and FIG. 5 are cross sections of the push-button switch during operation.

In those drawings, insulating board 11 has a plurality of conductive patterns (not shown) on both the top side and bottom side thereof. The conductive patterns are made of carbon ink or metallic foil. Also on insulating board 11, a pair of fixed contacts 11A are provided, and four pairs of fixed contacts 11B are also provided radially (i.e., in a circle) and are equally spaced apart.

Actuator 12 is made of resilient material such as rubber or elastomer. Base section 12A of actuator 12 overlies insulating board 11 and forms an approximately flat board. On base section 12A, first (primary) actuating section 12B protrudes upward, and four second (secondary) actuating sections 12C protrude upward. Linking section 12D links first (primary) actuating section 12B to base section 12A, and linking sections 12E link second (secondary) actuating sections 12C, respectively, to base section 12A. In this regard, the terms "primary", "secondary" and "tertiary" are used for identification purposes only, and are not intended to otherwise describe the relative operation or significance of the actuating sections. Linking sections 12D, 12E are each made of thin material and are each approximately dome-shaped.

On the bottom side of actuating sections 12B and 12C, movable contacts 12F and 12G are formed of, for example, carbon ink with a given space from corresponding fixed contacts 11A and 11B.

Urging body 13 and push-button 14 are made of insulating resin. Shaft 13A is provided at a first end of urging body 13. Shaft 13A is journaled by U-shaped supporting section 12H. Urging section 13B is provided at a second end of urging body 13, and is brought into contact with an upper surface of primary actuating section 12B. The bottom side of push-button 14 is brought into contact with the upper surface of mid section 13C of urging body 13.

Case 15, made of insulating resin, covers a part of or all of the elements discussed above. Case 15 has an opening on its lower side, and five holes 15A on its upper side. Through these holes 15A, push-button 14 and secondary actuating sections 12C protrude upward. When those elements discussed above are assembled, secondary actuating sections 12C are equally spaced apart around push-button 14. As shown in FIGS. 1 and 3 through 5, the case 15 also includes supporting section 15B. In particular, shaft 13A of urging body 13 is sandwiched between U-shaped supporting section 12H and supporting section 15B of case 15.

Operation of the push-button switch structured above is demonstrated hereinafter. The push-button switch is in neutral position in FIG. 3. When the upper surface of secondary actuating section 12C is depressed, the actuating section 12C moves downward so as to bend linking section 12E. As a result, movable contact 12G (at bottom side of actuating section 12C) is brought into contact with fixed contact 11B on the upper surface of board 11. As a result, contact 11B is closed as shown in FIG. 4.

When the depressing force is removed from actuating section 12C, movable contact 12G disconnects from fixed contact 11B (contact 11B is opened), and actuating section 12C springs back to the neutral position shown in FIG. 3.

On the other hand, when push-button 14 is at the neutral position shown in FIG. 1, the upper face of push-button 14 can be depressed. Then, the bottom side of push-button 14 depresses the upper side of mid section 13C of urging body 13, which causes urging body 13 to rotate downward on shaft 13 A held by supporting section 12H, so that urging section 13B pushes the upper face of primary actuating section 112B. As a result, actuating section 12B moves downward so as to bend linking-section 12D, and movable contact 12F provided at bottom side of actuating section 12B is brought into contact with fixed contact 11A on board 11. Contact 11A is thus closed (electrically connected.)

When the depressing force is removed from push-button 14, primary actuating section 12B springs back upward due to the resilient restoring force of linking-section 12D, and actuating section 12B pushes urging body 13 (as well as push-button 14) back to the neutral position shown in FIG. 1.

Thus, push-button 14 depresses mid-section 13C of urging body 13, which then rotates on shaft 13A at the first end of urging body 13 so that urging section 13B at the second end of urging body 13 pushes the upper surface of actuating section 12B. In this case, a greater operating force is produced by push-button 14 and a smaller pushing stroke is required than when actuating section 12B is directly depressed. For instance, when mid section 13C is positioned at approximately the center of urging body 13, as much as about twice the operating force is produced by push-button 14 and half of the stroke is required as compared with the case in which actuating section 12B is directly depressed. The distance between mid-section 13C and shaft 13A decreases at a greater operating force and a smaller stroke.

The push-button switch structured above is mounted to an operation panel of an electronic apparatus, and connected to the electronic circuit of the apparatus. For instance, any one of the four secondary actuating sections 12C can be depressed, thereby moving the cursor on the screen. Then push-button 14 can be depressed, thereby selecting an item from a menu. This usage is the same as the prior art.

According to the first embodiment, primary actuating section 12B is urged indirectly through urging body 13 by depressing push button 14, while secondary actuating section 12C is directly urged. Therefore, actuating sections 12B and 12C can have largely different operating forces and strokes. As a result, operating forces and strokes of various combinations can be produced by this push-button switch.

A plurality of fixed contacts 11A and 11B are arranged on board 11, and movable contacts 12F and 12G are disposed on the bottom side of actuating sections 12B and 12C at a given distance from contacts 11A and 11B, so that contacts 12F and 12G face contacts 11A and 11B. This structure allows the switch-contacts to be simply built with less components at a lower cost.

Instead of movable contacts 12F and 12G, a resilient insulating film can be bonded to the upper surface of a board at a given distance from the board (like an arch bridge), and a plurality of movable contacts facing the fixed contacts 12F and 12G are then formed on the bottom side of the film. The upper side of these movable contacts is depressed by actuating sections 12B and 12C. The switch-contacts of a membrane type can thus be employed.

Exemplary Embodiment 2

Figure 6:
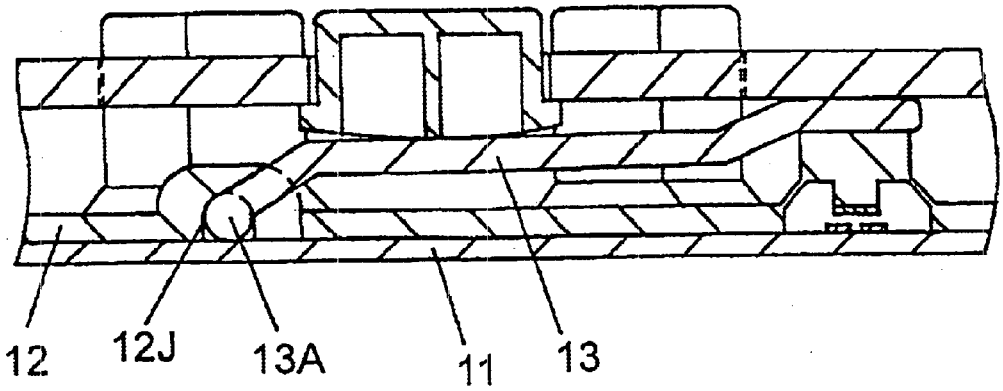
FIG. 6 is a cross section of a push-button switch in accordance with a second exemplary embodiment of the present invention.

FIG. 6 is a cross section of a push-button switch in accordance with a second exemplary embodiment of the present invention. The second embodiment differs from the first one in the following point. In the first embodiment, shaft 13A—the end of urging body 13—is journaled between supporting section 12H of actuator 12 and a protrusion on the bottom side of case 15; (specifically, supporting section 15B). However, in the second embodiment, shaft 13A is journaled between supporting section 12J, formed on the bottom side of actuator 12, and the upper surface of insulating board 11 as shown in FIG. 6. As explained above with respect to the first embodiment, actuator 12 is formed of resilient material, such as rubber or elastomer. Therefore, shaft 13A of urging body 13 can be inserted into supporting section 12J from above or the side since supporting section 12J can be elastically deformed to expand along the longitudinal direction of shaft 13A. The second embodiment can achieve the same advantages as the first one.

Exemplary Embodiment 3

Figure 7:
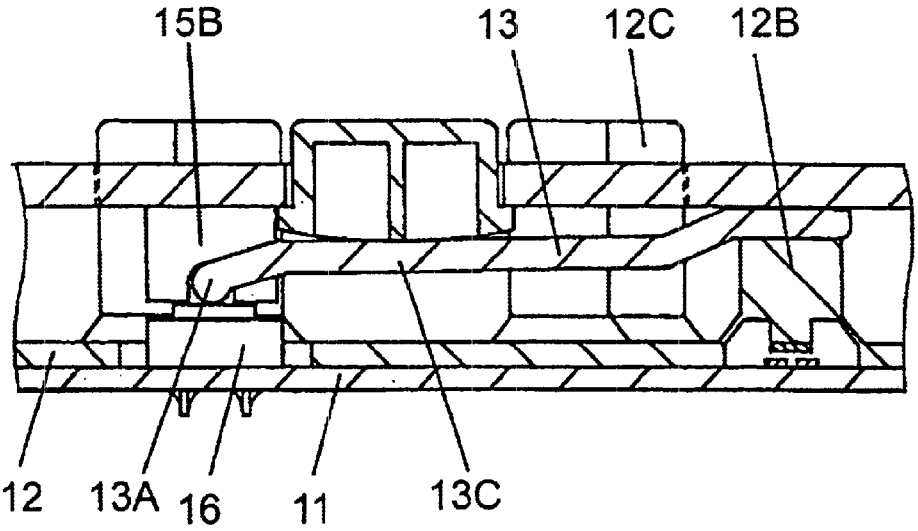
FIG. 7 is a cross section of a push-button switch in accordance with a third exemplary embodiment of the present invention.

FIG. 7 is a cross section of a push-button switch in accordance with the third exemplary embodiment of the present invention. The third embodiment differs from the first one in the following point: Push switch (switch contact) 16 is disposed on the upper face of board 11, as shown in FIG. 7. Switch contact 16 is urged (pushed) by shaft 13A of urging body 13, and is switched at a different timing than that of the contacts switched by primary actuating section 12B or secondary actuating section 12C. Therefore, more versatile switching operations can be provided in this push-button switch than in the first embodiment. Switch contact 16 can also be urged by mid section 13C instead of shaft 13A.

Exemplary Embodiment 4

Figure 8:
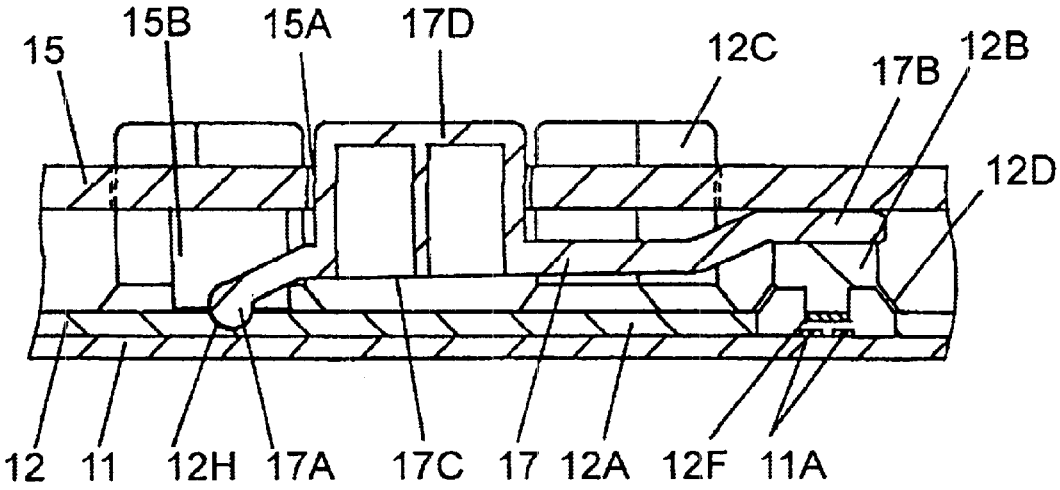
FIG. 8 is a cross section of a push-button switch in accordance with a fourth exemplary embodiment of the present invention.

FIG. 8 is a cross section of a push-button switch in accordance with the fourth exemplary embodiment of the present invention. The fourth embodiment differs from the first one in the following point: In the first embodiment, urging body 13 and push button 14 are independently formed as shown in FIG. 1. However, in the fourth embodiment, a protrusion extending from mid-section 17C of urging body 17 functions as the push button, so that the push button is unitarily formed (i.e., formed as one piece) with urging body 17 as operating section 17D.

Operation of the fourth embodiment is demonstrated here. When operating section 17D, protruding from the upper surface of case 15, is depressed, urging body 17 (unitarily formed with operating section 17D) rotates downward on shaft 17A at the first end. Then, urging section 17B at the second end of urging body 17 urges the first actuating section 12B downward.

Actuating section 12B moves downward so as to bend linking-section 12D, and movable contact 12F provided on the bottom side of actuating section 12B is brought into contact with fixed contact 11A on board 11. Thus, fixed contact 11A is electrically connected via movable contact 12F. When the depressing force is removed from operating section 17D, actuating section 12B springs back upward due to the resilient restoring force of linking-section 12D, and actuating section 12B pushes urging body 17 back to the original position.

As such, according to the fourth embodiment, a push button, i.e. operating section 17D, is unitarily formed with urging body 17 at mid section 17C. Thus, obtaining an inexpensive push-button switch with fewer components and easy construction can be obtained.

Exemplary Embodiment 5

Figure 9:
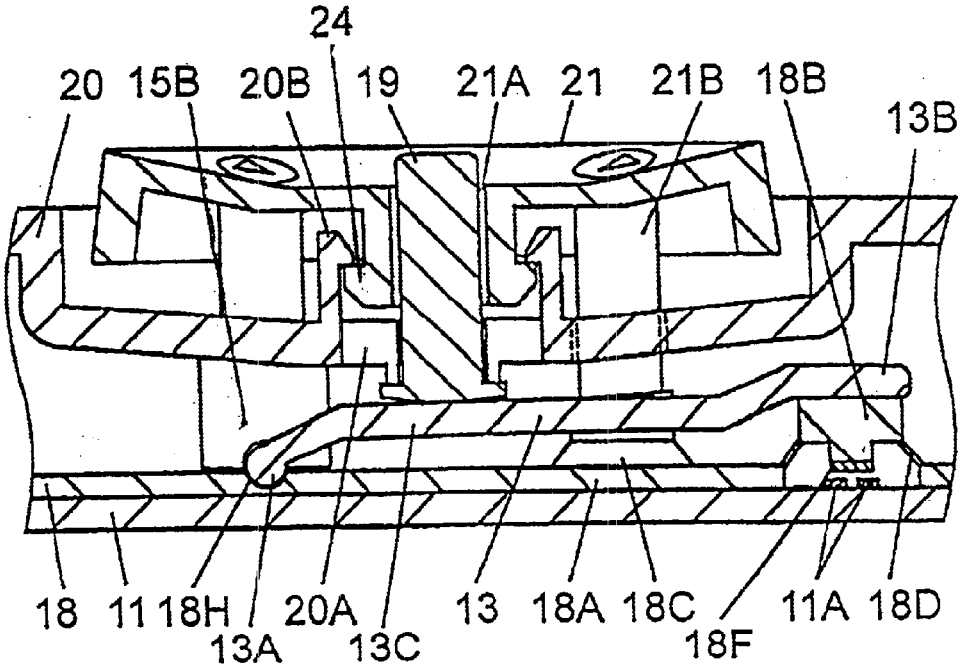
FIG. 9 is a cross section of a push-button switch in accordance with a fifth exemplary embodiment of the present invention.
Figure 10:
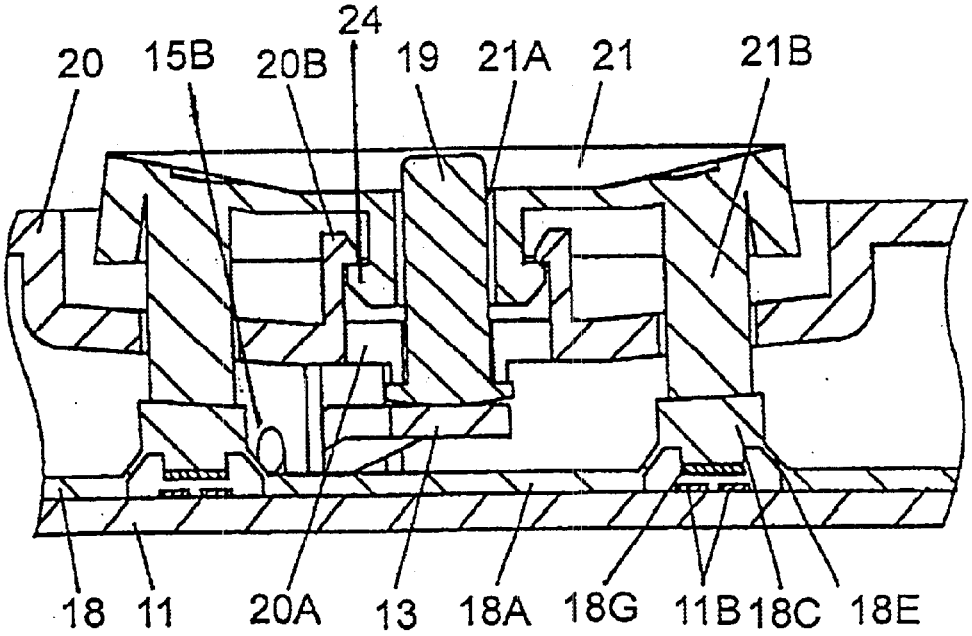
FIG. 10 is a cross section of the push-button switch in accordance with the fifth exemplary embodiment taken along a line different from that of FIG. 9.

FIG. 9 is a cross section of a push-button switch in accordance with the fifth exemplary embodiment of the present invention. FIG. 10 is a cross section of the push-button switch taken along a line different from FIG. 9.

The fifth embodiment differs from the first one in the following point. In FIG. 10, push-button 19 protrudes upward through opening 20A of case 20, as in the first embodiment. In this fifth embodiment, engaging claw 20B is provided on case 20 for engaging shoulder portion 24 of hat button 21, so that the center of hat button 21 (made of insulating resin) is engaged in a rocking manner with claw 20B.

The tip of push-button 19 protrudes out of through-hole 21A formed at the center of hat button 21. Four protrusions 21B provided on the bottom side rim of hat button 21 are brought into contact with the upper side of four secondary actuating sections 18C, so that a push-switch is constructed.

Operation of the fifth embodiment is explained hereafter. At the neutral position shown in FIG. 9, push-button 19 is depressed, and urging body 13 rotates downward on shaft 13A, so that urging section 13B pushes the upper face of primary actuating section 18B. As a result, fixed contact 11A is coupled electrically to movable contact 18F. This arrangement is the same as the first embodiment. In this fifth embodiment, actuating section 18C is depressed by rocking hat-button 21.

In other words, at the neutral position shown in FIG. 10, when the right side of the upper surface of hat button 21 is depressed, for instance, hat button 21 rocks on the center of the bottom side engaged with claw 20B of case 20 as a fulcrum. Then protrusion 21B disposed at the bottom side rim of hat button 21 depresses the upper surface of actuating section 18C. This depression causes actuating section 18C to move downward so as to bend linking-section 18E, so that fixed contact 11B is coupled electrically to movable contact 18G.

The push-button switch structured as described above is mounted to an operation panel of an electronic apparatus, and connected to the electronic circuit of the apparatus. For instance, hat button 21 is rocked, thereby moving the cursor on the screen. After that, push-button 19 at the center is depressed to select an item from a menu. This usage is the same as the first embodiment.

According to the fifth embodiment, hat button 21 is provided and has through-hole 21A at its center through which push-button 19 protrudes. Rocking this hat button 21 depresses actuating section 18C at the outer rim of hat button 21. Thus, a spot somewhat deviated on the upper surface of hat button 21 is depressed, and actuating section 18C thereunder can be depressed without failure. As a result, a push-button switch easy to operate is obtainable.

Exemplary Embodiment 6

Figure 11:
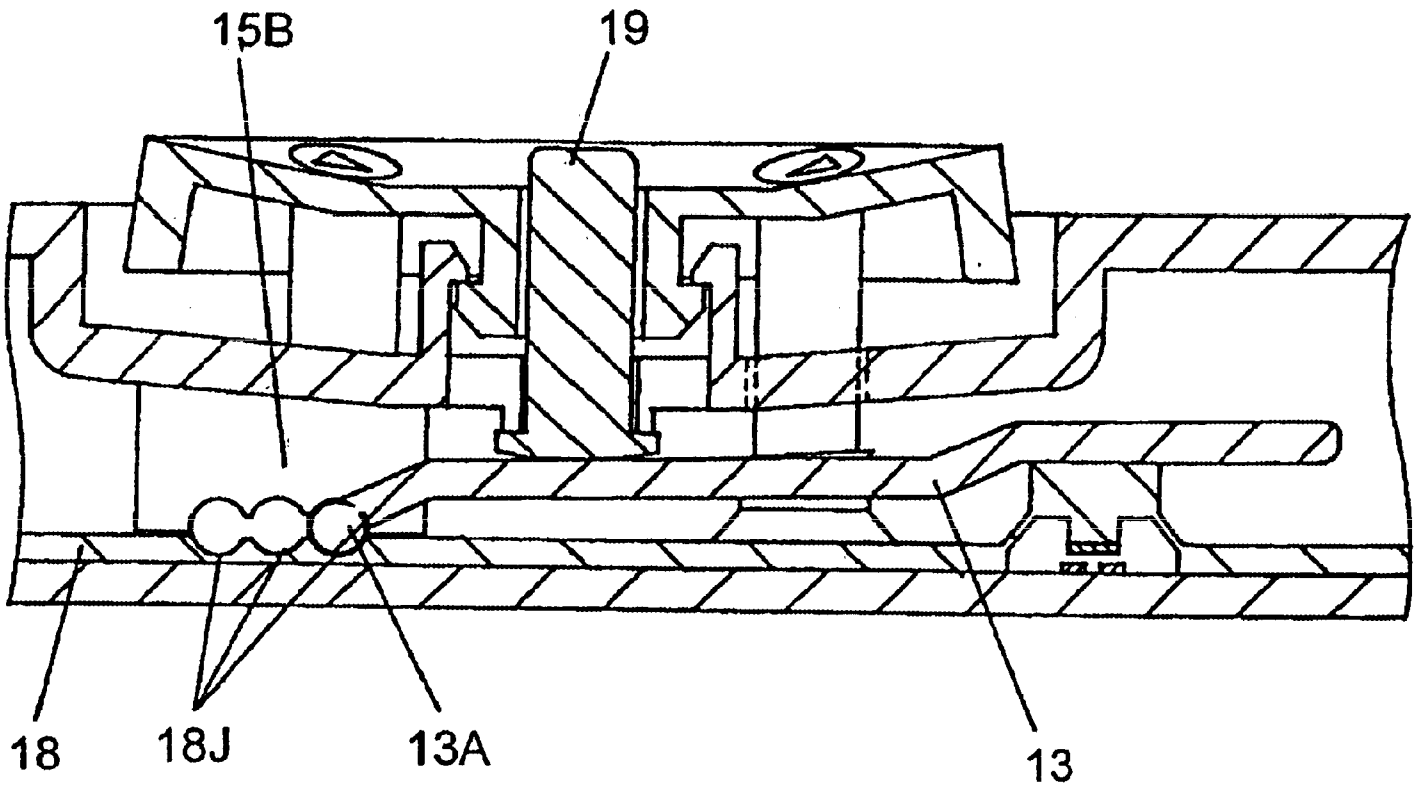
FIG. 11 is a cross section of a push-button switch in accordance with a sixth exemplary embodiment of the present invention.

FIG. 11 is a cross section of a push-button switch in accordance with the sixth exemplary embodiment of the present invention. The sixth embodiment differs from the first one in the following point: As shown in FIG. 11, a plurality of approximately U-shaped supporting sections 18J are provided in actuator 18 so that shaft 13A of urging body 13 can be supported by a plurality of the supporting sections. As shown in FIG. 11, supporting section 15B of case 15 also includes a set of U-shaped supporting regions I 5J corresponding to the supporting sections 18J formed in actuator 18. This structure allows push-button 19 to easily change its operating force as well as stroke without changing the parts by just changing the particular supporting section 18J where shaft 13A is inserted.

Exemplary Embodiment 7

Figure 12:
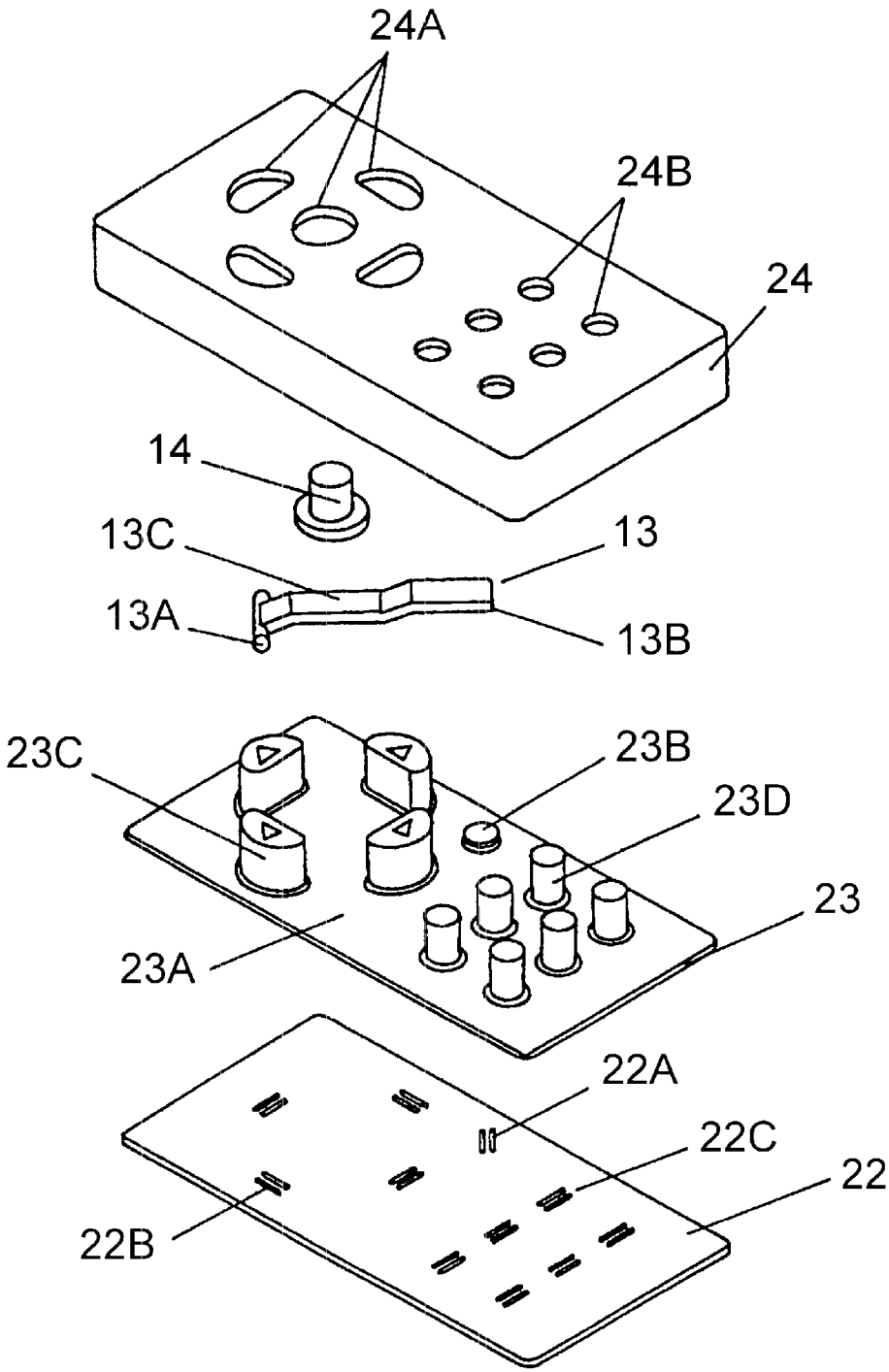
FIG. 12 is an exploded perspective view of a multi-switch device in accordance with a seventh exemplary embodiment of the present invention.
Figure 13:
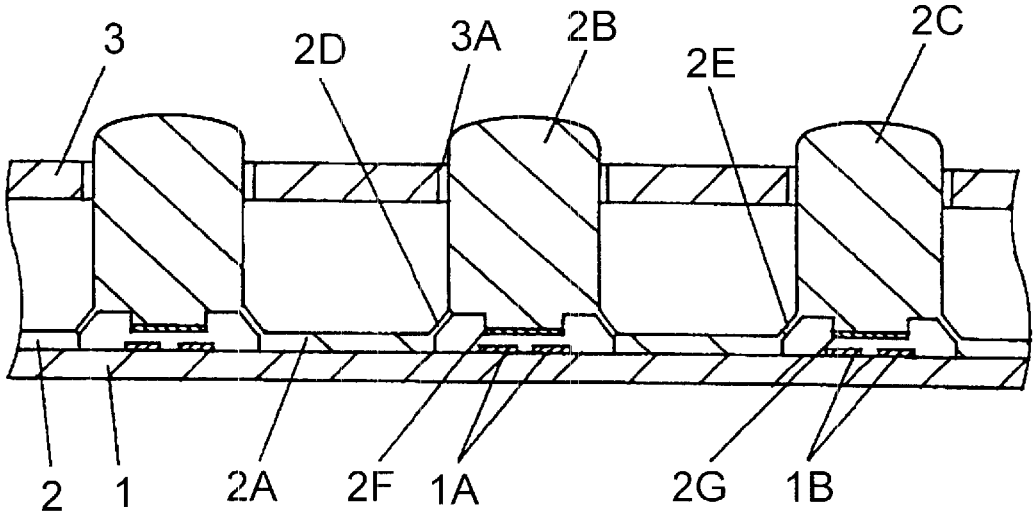
FIG. 13 PRIOR ART
FIG. 13 is a cross section of a conventional push-button switch.
Figure 14:
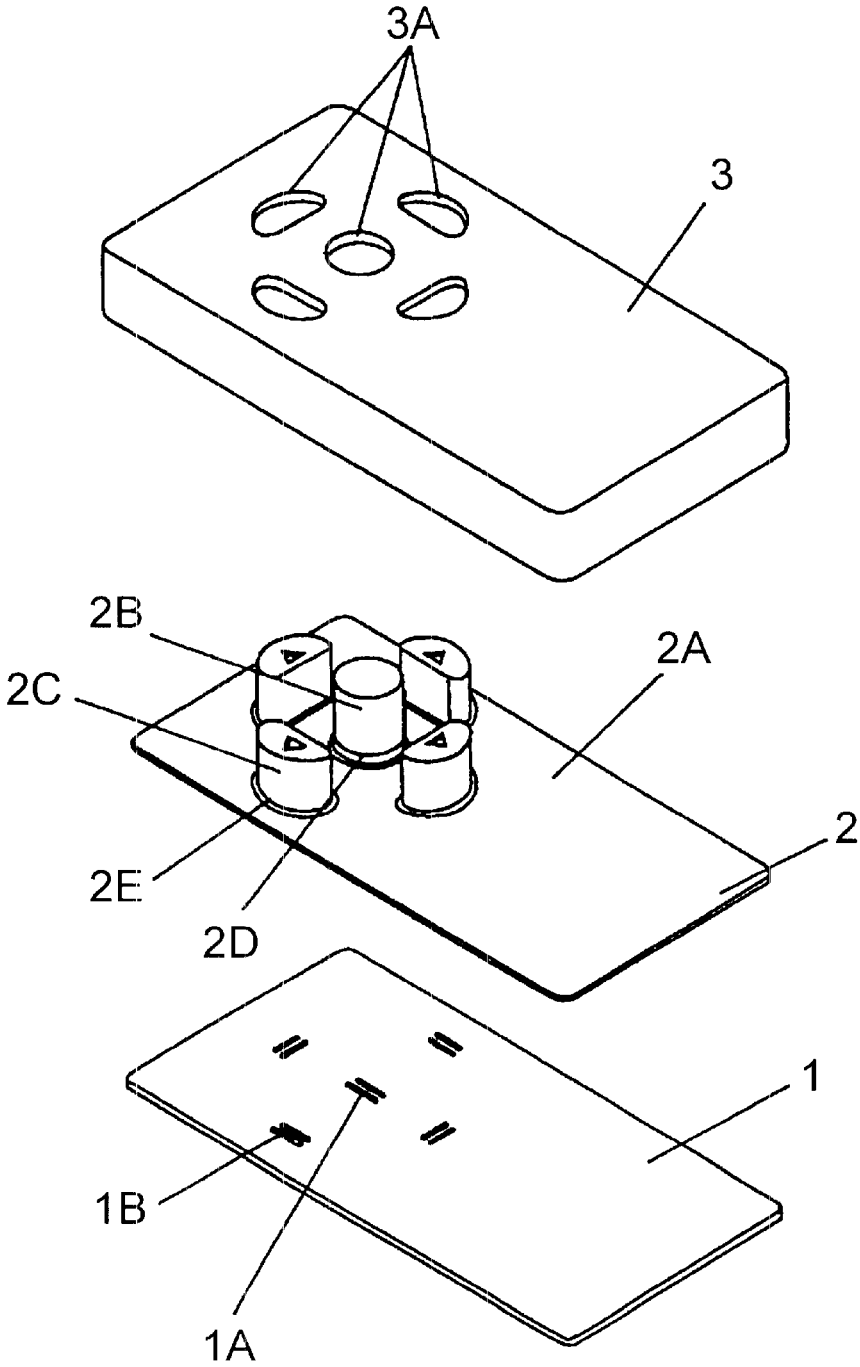
FIG. 14 PRIOR ART
FIG. 14 is an exploded perspective view of the push-button switch shown in FIG. 13.
Figure 15:
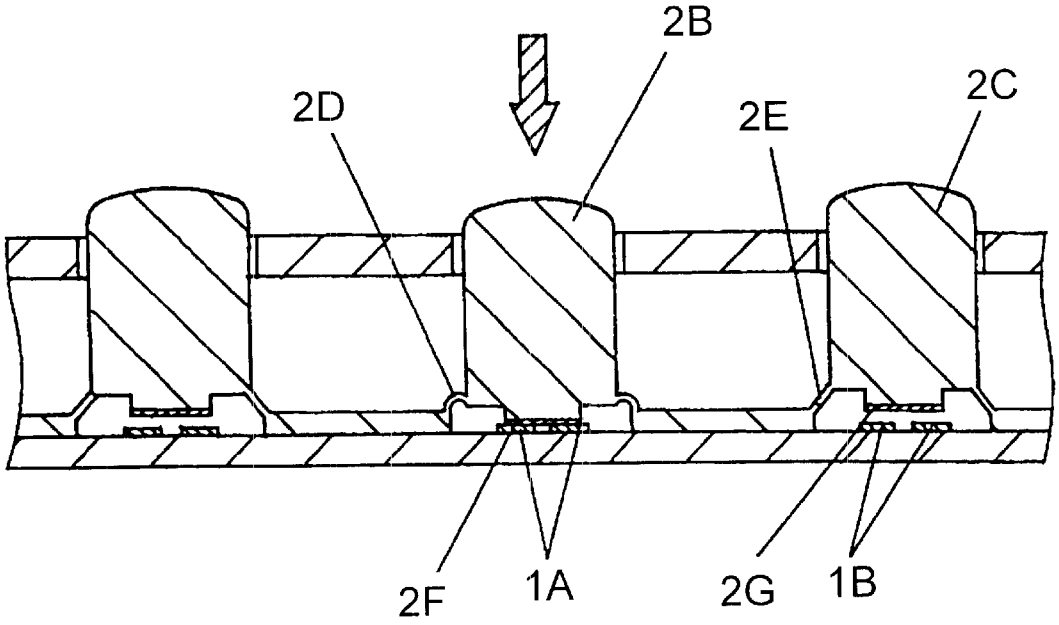
FIG. 15 PRIOR ART
FIG. 15 is a cross section of the conventional push-button switch at operation.

FIG. 12 is an exploded perspective view of a multi-switch in accordance with a seventh exemplary embodiment of the present invention. In FIG. 12, the following structural points are the same as the first embodiment: (1) A pair of fixed contacts 22A and four pairs of fixed contacts 22B are disposed on the upper surface of insulating board 22. (2) Primary actuating section 23B and four second actuating sections 23C are formed on the upper surface of base section 23A of actuator 23. (3) Shaft 13A at a first end of urging body 13 is journaled (supported) by actuator 23. (4) Urging section 13B at a second end of urging body 13 is brought into contact with the upper surface of actuator 23B, and the bottom side of push-button 14 is brought into contact with the upper surface of mid-section 13C.

This seventh embodiment differs from the first one in the following point: On the upper surface of base section 23A of actuator 23, a plurality of third (tertiary) actuating sections 23D are formed. in addition to, and similar to, actuating sections 23B and 23C. Movable contacts (not shown) are formed on the respective bottom sides of actuating sections 23D, and fixed contacts 22C are formed on the upper surface of insulating board 22 corresponding to and spaced apart from the movable contacts. Case 24 covers those elements, and push-button 14 and actuating sections 23C protrude upward through openings 24A. A plurality of tertiary actuating sections 23D protrude upward from openings 24B. A multiple switch is thus constructed.

The push-button switch structured as described above is mounted to an operation panel of an electronic apparatus, and is connected to the electronic circuit of the apparatus. For instance, actuating section 23C is depressed, thereby moving the cursor on the screen. Then push-button 14 is depressed, thereby selecting an item from a menu. This arrangement is the same as in the first embodiment. However, in the seventh embodiment, depressing actuating sections 23D can switch functions other than those discussed above in the apparatus.

According to the seventh embodiment, a plurality of actuating sections 23D are provided in addition to the push-button switch shown in the first embodiment, so that a plurality of switches are formed. As a result, a multiple switch having versatile functions with less components is obtained at an inexpensive cost and by simple assembly.

In the descriptions above, the push-button switch or the multiple switch is mounted to an operation panel of an electronic apparatus and coupled to an electronic circuit. However, electronic parts are mounted on an insulating board to form a transmitting circuit, thereby constructing a remote controlling transmitter independent of the electronic apparatus.

According to the present invention, a push-button switch using various combinations of operating forces and strokes is obtained, and a multiple switch using the push-button switch is also obtainable.

What is claimed is:

1. A push-button switch comprising:

a case having through-holes formed therethrough;

an insulating board having a plurality of switch contacts formed thereon;

an actuator formed of resilient material, said actuator including:

a base section arranged on said insulating board; and a first actuating section and a second actuating section arranged over said switch contacts on said insulating board, each of said first actuating section and said second actuating section being coupled to said base section via a respective linking section, said second actuating section protruding through a first one of said through-holes in said case;

an urging body including:

a first end rotatably supported by at least one of a supporting section of said actuator and a supporting section of said case; and a second end for pushing said first actuating section; and a push button for pushing a center section of said urging body between said first end and said second end, said push button protruding through a second one of said through-holes in said case.

2. The push-button switch of claim 1, wherein said first actuating section is enclosed by said case so as not to protrude through said case.

3. The push button switch of claim 1, wherein said first end of said urging body has a shaft, and said second end of said urging body has an urging section.

4. The push button switch of claim 3, wherein said actuator has a plurality of supporting sections, said shaft being supported by one of said supporting sections and being operable to be moved to each of said supporting sections.

5. The push button switch of claim 4, wherein said case has a supporting section having a plurality of supporting regions corresponding to said supporting sections of said actuator, said shaft being supported between one of said supporting sections of said actuator and a corresponding one of said supporting regions of said case.

6. The push button switch of claim 3, wherein said insulating board has a switch contact arranged thereon so as to be pushed by one of said shaft of said urging body and said center section of said urging body.

7. The push button switch of claim 1, wherein each of said linking sections are substantially dome-shaped.

8. The push button switch of claim 1, wherein said second actuating section is arranged at an outer circumference of said push button.

9. The push button switch of claim 1, wherein each of said switch contacts is fixed on an upper surface of said insulating board, further comprising a plurality of moving switch contacts arranged on a bottom surface of each of said first actuating section and said second actuating section so as to be spaced apart from and facing said fixed contacts on said insulating board.

10. The push button switch of claim 1, wherein said push button is unitarily formed as a single unit with said urging body at said center section of said urging body.

11. A multiple switch comprising:

push-button switch including:

a case having through-holes formed therethrough;

an insulating board having a first group of switch contacts formed thereon;

an actuator formed of resilient material, said actuator including:

a base section arranged on said insulating board; and a first actuating section and a second actuating section arranged over said first group of switch contacts on said insulating board, each of said first actuating section and said second actuating section being coupled to said base section via a respective linking section, said second actuating section protruding through a first one of said through-holes in said case;

an urging body including:

a first end rotatably supported by at least one of a supporting section of said actuator and a supporting section of said case; and a second end for pushing said first actuating section; and a push button for pushing a center section of said urging body between said first end and said second end, said push button protruding through a second one of said through-holes in said case;

a third actuating section formed on said base section of said actuator of said push-button switch; and a second group of switch contacts arranged on an upper surface of said insulating board under said third actuating section.

12. The push-button switch of claim 11, wherein said first actuating section is enclosed by said case so as not to protrude through said case.

13. The push button switch of claim 11, wherein said first end of said urging body has a shaft, and said second end of said urging body has an urging section.

14. The push button switch of claim 13, wherein said actuator has a plurality of supporting sections, said shaft being supported by one of said supporting sections and being operable to be moved to each of said supporting sections.

15. The push button switch of claim 14, wherein said case has a supporting section having a plurality of supporting regions corresponding to said supporting sections of said actuator, said shaft being supported between one of said supporting sections of said actuator and a corresponding one of said supporting regions of said case.

16. A push-button switch comprising:

a case having through-holes formed therethrough;

an insulating board having a plurality of switch contacts formed thereon;

an actuator formed of resilient material, said actuator including:

a base section arranged on said insulating board; and a first actuating section and a second actuating section arranged over said switch contacts on said insulating board, each of said first actuating section and said second actuating section being coupled to said base section via a respective linking section;

an urging body including:

a first end rotatably supported by at least one of a supporting section of said actuator and a supporting section of said case; and a second end for pushing said first actuating section;

a push button for pushing a center section of said urging body between said first end and said second end; and a hat button having a center through-hole and having a protrusion extending downward from a bottom surface of said hat button and through a first one of said through-holes in said case, said push button protruding through said center through-hole of said hat button and through a second one of said through-holes in said case, said second actuating section being arranged under said protrusion of said hat button so that said second actuating section is pushed via said protrusion by depressing said hat button, and said first actuating section is pushed by depressing said push button.

17. The push-button switch of claim 16, wherein said first actuating section is enclosed by said case so as not to protrude through said case.

18. The push button switch of claim 16, wherein said hat button has a shoulder portion formed around said center through-hole, and said case has an engaging claw formed around said first one of said through-holes for en(gaging said shoulder portion of said hat button.

19. The push button switch of claim 16, wherein said first end of said urging body has a shaft, and said second end of said urging body has an urging section.

20. The push button switch of claim 19, wherein said actuator has a plurality of supporting sections, said shaft being supported by one of said supporting sections and being operable to be moved to each of said supporting sections.

* * * * *

UNITED STATES PATENT AND TRADEMARK OFFICE

CERTIFICATE OF CORRECTION

PATENT NO. : 6,621,017 B2
DATED : September 16, 2003
INVENTOR(S) : Shigeru Shibutani et al.

It is certified that error appears in the above-identified patent and that said Letters Patent is hereby corrected as shown below:

Column 10,
Line 40, change “en(gaging” to -- engaging --.

Signed and Sealed this

Twentieth Day of January, 2004

JON W. DUDAS
*Acting Director of the United States Patent and Trademark Office*